United States Patent [19]

Endo et al.

[11] 4,373,416

[45] Feb. 15, 1983

[54] WAVE GENERATOR FOR ELECTRONIC MUSICAL INSTRUMENT

[75] Inventors: Akinori Endo; Hirokazu Kato, both of Hamamatsu, Japan

[73] Assignee: Nippon Gakki Seizo Kabushiki Kaisha, Shizuoka, Japan

[21] Appl. No.: 214,939

[22] Filed: Dec. 10, 1980

Related U.S. Application Data

[63] Continuation of Ser. No. 865,272, Dec. 28, 1977, abandoned.

[30] Foreign Application Priority Data

| | | | |
|---|---|---|---|
| Dec. 29, 1976 | [JP] | Japan | 51-158945 |
| Dec. 29, 1976 | [JP] | Japan | 51-158946 |
| Dec. 29, 1976 | [JP] | Japan | 51-158947 |
| Dec. 29, 1976 | [JP] | Japan | 51-158949 |

[51] Int. Cl.[3] ..... G10H 1/00

[52] U.S. Cl. ..... 84/1.01; 84/1.26

[58] Field of Search ..... 84/1.01, 1.03, 1.26, 84/1.13; 364/718

[56] References Cited

U.S. PATENT DOCUMENTS

| | | | |
|---|---|---|---|
| 4,079,650 | 3/1978 | Deutsch et al. | 84/1.03 |
| 4,083,285 | 4/1978 | Chibana | 84/1.13 |
| 4,128,032 | 12/1978 | Wada et al. | 84/1.26 |
| 4,184,400 | 1/1980 | Niimi | 84/1.03 |

*Primary Examiner*—J. V. Truhe
*Assistant Examiner*—Forester W. Isen
*Attorney, Agent, or Firm*—Jordan and Hamburg

[57] ABSTRACT

In a wave generator for an electronic musical instrument, a plurality of sampling values of a musical tone waveform having a given envelope are simultaneously carried out in a time division system according to the musical tone waveform calculation sequence which can be varied as required; more specifically, calculation for generating a musical tone waveform is carried out while advancing phase, the envelope given to the musical tone waveform is divided into plural segments whose time intervals can be changed as desired, and phase increment values are set for the segments thus obtained while increment values are set for the phase increment values, respectively, these values being accumulated to carry out the calculation of the musical tone waveform, whereby the musical tone waveform and its envelope are varied intricately to produce musical tones rich in natural feeling.

25 Claims, 9 Drawing Figures

Fig. 1

| TERM | ABBREVIATION |
|---|---|
| INSTRUCTION ADDRESS 5~0 | INST ADRS 5~0 |
| PIPELINED INITIAL SEGMENT ADDRESS 3~0 | PLD INIT SEG ADRS 3~0 |
| PIPELINED INSTRUCTION ADDRESS 5~0 | PLD INST ADRS 5~0 |
| ENVELOPE | ENV |
| FREQUENCY | FREQ |
| INCREMENT VALUE | INC |
| INITIAL VALUE (INITIAL STATE) | INIT |
| ADDRESS | ADRS |
| SEGMENT | SEG |
| REGISTER | REG |
| COUNT | CNT |
| REQUEST | REQ |
| INITIAL SEGMENT ADDRESS 3~0 | INIT SEG ADRS 3~0 |

Fig. 7

$$Y = A\,SIN(\omega_0 t + I_1\,SIN\,\omega_1 t + I_2\,SIN\,\omega_2 t)$$

| | |
|---|---|
| T0 | |
| T1 | $I_1 \quad \Delta I_1 \quad \omega_1 t \quad \Delta\omega_1 t$ |
| T2 | $\overset{(R_1)}{I_1 + \Delta I_1} \quad \overset{(R_3)}{\omega_1 t + \omega_1 t} \quad I_2 \quad \Delta I_2 \quad \omega_2 t \quad \Delta\omega_2 t$ |
| T3 | $\overset{(R_2)}{I_1 + \Delta I_1} \quad SIN\,\overset{(R_4)}{(\omega_1 t + \Delta\omega_1)} \quad \overset{(R_1)}{I_2 + \Delta I_2} \quad \overset{(R_3)}{\omega_2 t + \Delta\omega_2 t} \quad A_V \quad \Delta A_V$ |
| T4 | $(I_1 + \Delta I_1)\,\overset{(R_5)}{SIN}(\omega_1 t + \Delta\omega_1 t) \quad \overset{(R_2)}{I_2 + \Delta I_2} \quad SIN\,\overset{(R_4)}{(\omega_2 t + \Delta\omega_2 t)} \quad A \quad \Delta A \quad \omega t \quad \Delta\omega t$ |
| T5 | $(I_1 + \Delta I_1\,\overset{(R_3)}{SIN}(\omega_1 t + \Delta\omega_1 t) + (I_2 + \Delta I_2)\,SIN(\omega_2 t + \Delta\omega_2 t) + \omega t + \Delta\omega t \quad \overset{(R_1)}{A + \Delta A}$ |
| T6 | $SIN\{(\omega t + \overset{(R_4)}{\Delta\omega t} + (I_1 + \Delta I_1)\,SIN\,(\omega_1 t + \Delta\omega_1 t) + (I_2 + \Delta I_2)\,SIN\,(\omega_2 t + \Delta\omega_2 t)\} \quad \overset{(R_2)}{A + \angle A}$ |
| T7 | $A\,SIN\,(\overset{(R_5)}{\omega_0 t} + I_1\,SIN\,\omega_1 t + I_2\,SIN\,\omega_2 t)$ |
| T8 | $A\,SIN\,(\overset{(OUT)}{\omega_0 t} + I_1\,SIN\,\omega_1 t + I_2\,SIN\,\omega_2 t)$ |
| T9 | |

Fig. 8

| | CHANNEL ADRS | | | | RD ECNT | RD ΔA | RD AV | | GATE MULK | FREQ SEL | LD OUT | LD R5 | LD R4 | LD R3 | LD R2 | LD R1 |
|---|---|---|---|---|---|---|---|---|---|---|---|---|---|---|---|---|
| | 3 | 2 | 1 | 0 | | | | | | | | | | | | |
| T0 | 0 | 0 | 0 | 0 | 1 | | | | | | | | | | | |
| T1 | 0 | 0 | 0 | 0 | | | | | | | | | | | | |
| T2 | 0 | 0 | 0 | 0 | | | | | | | | | | 1 | | 1 |
| T3 | 0 | 0 | 0 | 0 | | | 1 | | | | | | 1 | 1 | 1 | 1 |
| T4 | 0 | 0 | 0 | 1 | | 1 | | | 1 | 1 | | 1 | 1 | | 1 | |
| T5 | 0 | 0 | 0 | 1 | | | | | | | | | | 1 | | 1 |
| T6 | 0 | 0 | 0 | 1 | | | | | | | | | 1 | | 1 | |
| T7 | 0 | 0 | 0 | 1 | | | | | | | | 1 | | | | |
| T8 | 0 | 0 | 1 | 0 | | | | | | | 1 | | | | | |
| T9 | 0 | 0 | 1 | 0 | | | | | | | | | | | | |

WAVE GENERATOR FOR ELECTRONIC MUSICAL INSTRUMENT

This is a continuation of application Ser. No. 865,272, filed Dec. 28, 1977, now abandoned.

BACKGROUND OF THE INVENTION

This invention relates to a wave generator for a digital type electronic musical instrument.

Musical tone waveforms generated by ordinary musical instruments are intricately changed with the lapse of time.

In a conventional electronic musical instrument, an envelope is given to a musical tone waveform generated by the operation of a key in the keyboard, for the period of time of from the time instant when the musical tone wave rises to the time instant when it is ended, thereby to produce a musical tone. This envelope is varied in response to the on-off operation of a key, that is, it is very simple. In addition, the musical tone waveform itself is maintained unchanged for the period of time of from its rising time to its ending time. Thus, the produced musical tone is fixed with respect to the lapse of time.

Accordingly, the musical tones produced by the conventional electronic musical instrument are monotonous when compared with those produced by the ordinary musical instruments, and feel unnatural.

The above-described envelope and waveform given to musical tones in the conventional electronic musical instrument cannot be readily changed after it has been manufactured. This is also one of the disadvantages accompanying the conventional electronic musical instrument.

SUMMARY OF THE INVENTION

Accordingly, a primary object of this invention is to provide a wave generator for an electronic musical instrument in which a waveform calculating circuit is constituted by a microprogram memory and so forth so as to be able to change the waveform calculation sequence and accordingly to vary a musical tone waveform and its envelope intricately, whereby musical tones very close to natural tones can be produced and the computation can be carried out most effectively by utilizing a time division system.

Another object of the invention is to provide a wave generator for an electronic musical instrument in which an envelope given to a musical tone waveform is divided into a plurality of segments having optional time intervals, and increment values in both phase and envelope are set for every segment, thereby to carry out the waveform calculation.

The foregoing objects and other objects of the invention have been achieved, according to the invention, by the provision of a wave generator for an electronic musical instrument, which comprises a microprogram memory for storing a musical tone calculation sequence which can be changed as desired and for allowing calculation of a plurality of sampling values of a musical tone waveform having a given envelope to be simultaneously carried out in a time division system, an arithmetic circuit which is controlled by the microprogram memory to carry out predetermined calculations, a plurality of register for storing frequency data, envelope data or arithmetic intermediate results inputted during the waveform calculation, a function table out of which values corresponding to the inputted frequency data are read, and a multiplier in which a value read out of the function table is multiplied by an envelope data.

The wave generator for an electronic musical instrument according to the invention further comprises a segment memory, various selector registers, an envelope accumulator, a frequency accumulator, a frequency increment value accumulator, various addition circuits, a rate count register, an envelope count register, a first control circuit for controlling the rate count register, and a second control circuit for controlling the envelope count register in order to achieve the foregoing objects and other objects of the invention.

The nature, principle and utility of the invention will become more apparent from the following detailed description and the appended claims when read in conjunction with the accompanying drawings in which like parts are designated by like reference numerals or characters.

BRIEF DESCRIPTION OF THE DRAWINGS

In the accompanying drawings:

FIG. 1 is a table indicating technical terms used in this specification;

FIG. 7 is a diagram indicating one example of a waveform calculating process in the embodiment;

FIG. 8 is a diagram indicating states of microinstruction outputs during the waveform calculation operation in the embodiment.

DETAILED DESCRIPTION OF THE INVENTION

One example of an electronic organ to which this invention is applied will be described with reference to the accompanying drawings.

Figure 2:
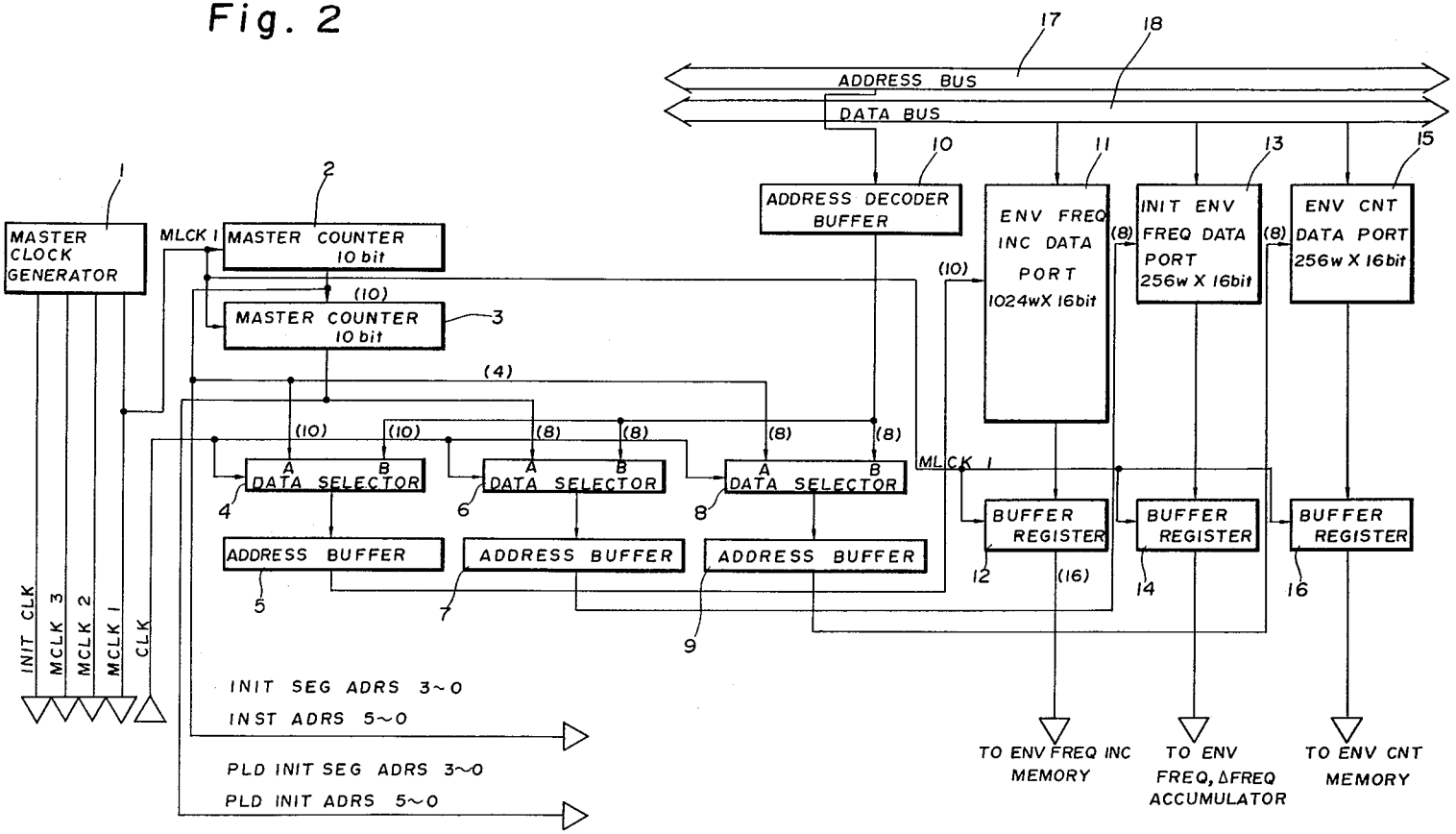
FIG. 2 is a block diagram illustrating an arrangement of an interface section for an assigner according to one embodiment of this invention applied to a wave generator of an electronic organ.

FIG. 1 is a table indicating technical terms and their abbreviations employed in this specification for simplification in description. In addition, a wave generator in the example is provided with a plurality of musical tone waveform calculation systems so as to simultaneously generate a plurality of musical tone waveforms. These calculation systems will be referred to as "channels", respectively, hereinafter. In this case, it is possible to use wave generators the number of which is equal to that of the channels, or to use one wave generator by assigning it to the channels in a time division system. Shown in FIG. 2 is the arrangement of an interface for an assigner (described later) of the electronic organ, which includes data ports for receiving a variety of data through a data bus from the assigner, a master clock generator for various clock pulses for control, etc.

Briefly described, the assigner comprises a keyboard, a micro instruction generating section, an arithmetic section, a read only memory (or ROM), a random access memory (or RAM), and an interruption control circuit. Key-on and -off information is provided by the keyboard in response to the operation of a key. In the arithmetic section, arithmetic operations are carried out according to the key on and off information for forming a key-on request file and a key-off request file. The files thus formed are stored in the RAM. The micro instruction generating section is provided with a microprogram memory, which contains programs for detecting the key-on and key-off signals and for forming the aforementioned files, a program for modifying tone color data according to the key-on signal in the arithmetic section, a program for searching for an idle channel in a wave generator (described later) to load the tone color data therein, and a program for releasing a corresponding channel when a key-off signal is detected. The arithmetic section comprises an arithmetic and logical unit for carrying out arithmetic operations according to the above-described various programs, and a temporarily storing register. In the ROM are stored various tables such as for instance a tone lever index table, fundamental tone data, frequency information, and envelope information. The amplitude envelope (hereinafter referred to merely as "an envelope" when applicable) of a fundamental musical tone is divided into eight (8) segments. The frequency information includes eight phase increment values $\omega t_0$ through $\omega t_7$ specified in correspondence to the eight segments, the initial value $\phi$ of the tone's phase, and the initial value $\Delta\omega t$ of the phase increment value. The envelope information includes envelope increment values $\Delta A_0$ through $\Delta A_7$ specified in correspondence to the phase increment values $\omega t_0$ through $\omega t_7$, the initial value A of the envelope, rate count data, and envelope count data.

In the wave generator according to this invention, in waveform calculation the envelope of one tone is divided into eight segments so that waveform calculation is performed for every segment as described later, and for frequencies and envelopes of tones other than the above-described fundamental tone, data obtained by carrying out predetermined ratio calculation for the data of the fundamental tone in the arithmetic section of the assigner are delivered to the data port. The aforementioned envelope count data are to control the time widths of the segments.

The RAM is a memory for filing scratch pads for arithmetic operation in the arithmetic section, and for filing key-on requests, key-off requests and channel assignments.

The interruption control circuit is a control circuit to allow a routine concerning a key on and off detection for instance to interrupt into a main routine carrying out channel assignment for key on and off operations.

Referring to FIG. 2, the master clock generator 1 outputs four clock pulses $MCLK_1$, $MCLK_2$, $MCLK_3$ and INIT CLK different in phase (FIG. 3) at all times. The clock pulses $MCLK_1$ through $MCLK_3$ are outputted at a frequency of 4 MHz (250 ns per cycle) and are used in various circuits in the wave generator, while the clock pulse INIT CLK is outputted at a cycle of 256 $\mu$s. A master counter 2 is a 10-bit counter driven by the clock pulse $MCLK_1$. The output of the master counter 2 is applied to a 10-bit pipeline register 3 driven by the clock pulse $MCLK_1$. Out of the output of the counter 2, six lower bits are delivered, as instruction addresses INST ADRS 5-0, to a microprogram memory described later, while the remaining four higher bits are delivered, as initial segment addresses INIT SEG ADRS 3-0, to an envelope count memory ENV CNT MEMORY 76 described later. Out of the output of the pipeline register 3, six lower bits are delivered, as pipelined instruction addresses PLD INST ADRS 5-0, to a memorys MEMORY 66, FREQ INC MEMORY 67 ENV INC and to accumulators ENV ACC 54, FEEO ACC 55, and FREQ INC ACC 56, while the remaining four higher bits are delivered, as pipelined initial segment addresses PLD INIT SEG ADRS 3-0, to the ENV CNT MEMORY 76.

The data necessary for calculation of a musical tone waveform are envelope and phase initial values, envelope increment values for all segments (eight segments), phase increment values as frequency information, and periods of time for the segments, that is, $\phi$, $\Delta\omega t$, $\Delta\Delta\omega t$, and A, $\Delta A_0$–$\Delta A_7$. These data are introduced from the assigner through the data bus 18 to the respective data ports 11, 13 and 15. The ENV FREQ INC DATA PORT 11 has a capacity of 1024 w×16 bit and stores the envelope and phase increment values $\Delta A_0$–$\Delta A_7$, $\Delta\omega t_0$–$\Delta\omega t_7$, or $\Delta\Delta\omega t_0$–$\Delta\Delta\omega t_7$. The INIT ENV FREQ DATA PORT 13 has a capacity of 256 w×16 bit, and stores the envelope and phase initial values, A, $\phi$, $\phi'$ (the initial value $\Delta\omega t$ of the increment value). The ENV CNT DATA PORT 15 has a capacity of 256 w×16 bit, and stores the periods of time of the segments. Writing data in or reading data out of these data ports is carried out with the aid of addresses outputted by an address decoder buffer 10 described later, and the above-described master counter 10 and pipeline register 3.

The address decoder buffer 10 is of 8 bits, the output of which is applied to the input terminal B of a 10-bit data selector 4, and to the input terminals B of 8-bit data selectors 6 and 8. The output of the master counter 2 is applied to the input terminals A of the data counters 4 and 8, while the output of the pipeline register 3 is applied to the input terminal A of the data selector 6. These data selectors 4, 6 and 8 are driven by one and the same address selector signal CLK when accessed by the assigner. Address buffers 5, 7 and 9 are connected to the output sides of the data selectors 4, 6 and 8, respectively. The outputs of the address buffers 5, 7 and 9 are applied to the ENV FREQ INC DATA PORT 11, the INIT ENV FREQ DATA PORT 13, and the ENV CNT DATA PORT 15. In writing the above-described data from the assigner operating in asynchronization with one another into the data ports 11, 13 and 15 of the wave generator, an address selected is delivered to one of the data selectors 4, 6 and 8 through the address bus 17 and the address decoder buffer 10 from the assigner. After being picked up selectively by the data selectors 4, 6 and 8, the address is applied the corresponding address buffer 5, 7 or 9 to the corresponding data port 11, 13 or 15, where the address is designated. As a result, the data delivered through data bus 18 from the assigner are written in the data ports 11, 13 and 15 simultaneously.

Sixteen-bit buffer registers 12, 14 and 16 are connected to the output sides of the data ports 11, 13 and 15, respectively. These buffer registers 12, 14 and 16 are driven by the master clock $MCLK_1$.

Thus, a waveform calculation for a musical tone is started, and upon application of a start command signal, the data from the data ports 11, 13 and 15 are applied to the buffer registers 12, 14, and 16, respectively. The buffer registers 12, 14 and 16, being driven by the master clock $MCLK_1$, deliver the data to the accumulators 54 through 56 and the memories 66, 67 and 76 according to the PLD INST ADRS 5-0 and PLD INST SEG ADRS 3-0, whereby the data are stored therein.

In this specification, the aforementioned address bus 17, data bus 18 and control bus may be referred to as a common bus, when applicable.

Figure 4:
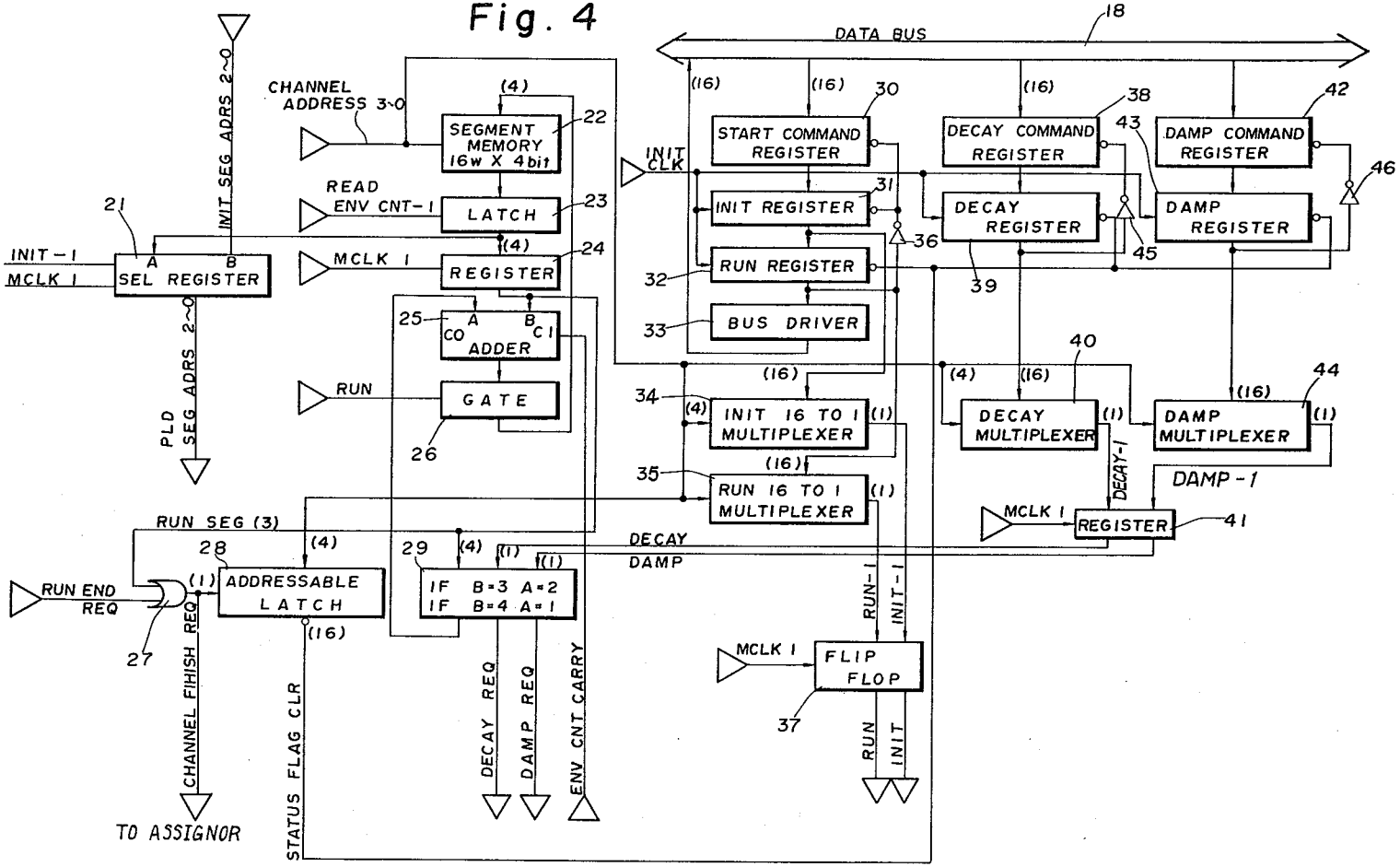
FIG. 4 is a block diagram illustrating a control circuit for controlling the operations of an envelope and frequency generating circuit and the relevant circuits in the embodiment.

Now, referring to FIGS. 4 and 6, a control circuit for controlling the operations of an envelope and frequency generating circuit (FIG. 5) and an arithmetic operation circuit (FIG. 6) will be described.

First of all, various microinstructions provided by a microprogram memory 47 will be described. This memory 47 is made up of a ROM or a RAM having a storage capacity of 64 w×16 bit. The micro program memory 47 is driven by the INST ADRS 5-0 having a period of 16 μs so as to read out the microinstructions periodically. The microinstructions thus read out are applied to an instruction register (or IR) 48. This instruction register 48 is driven by the master clock $MCLK_1$, and therefore the microinstructions read out of the memory 47 are outputted with a delay of 250 ns.

The microinstruction employed in the circuitry of this example is delivered to the above-described arithmetic operation circuit and memories in order to control the calculation squence thereof. Sometimes, at the timing of use of the aforementioned microinstruction, microinstructions outputted by the memory 47 are employed, or microinstructions outputted by the register 48 are employed. In this example, there are provided sixteen different microinstructions. The output signals from the output bits <0>-<15> of the register 48 represent the following instructions:

| | |
|---|---|
| Bit <0> | Load register 1 (LD REG 1) |
| Bit <1> | Load register 2 (LD REG 2) |
| Bit <2> | Load register 3 (LD REG 3) |
| Bit <3> | Load register 4 (LD REG 4) |
| Bit <4> | Load register 5 (LD REG 5) |
| Bit <5> | Load output buffer (LD OUT BUF) |
| Bit <6> | Frequency select (FREQ SEL) |
| Bit <7> | Gate multiplier K (GATE MUL K) |
| Bit <8> | (not used) |
| Bit <9> | Read Av (READ Av) |
| Bit <10> | Read A (READ A) |
| Bit <11> | Read envelope counter (READ ENV CNT) |
| Bit <12> | Channel address 3 (CHANNEL ADRS 3) |
| Bit <13> | Channel address 2 (CHANNEL ADRS 2) |
| Bit <14> | Channel address 1 (CHANNEL ADRS 1) |
| Bit <15> | Channel address 0 (CHANNEL ADRS 0) |

The signals, delayed by 250 ns, of the microinstructions CHANNEL ADRS 3-0 are referred to as microinstructions PLD CHANNEL ADRS 3-0.

Figure 3:
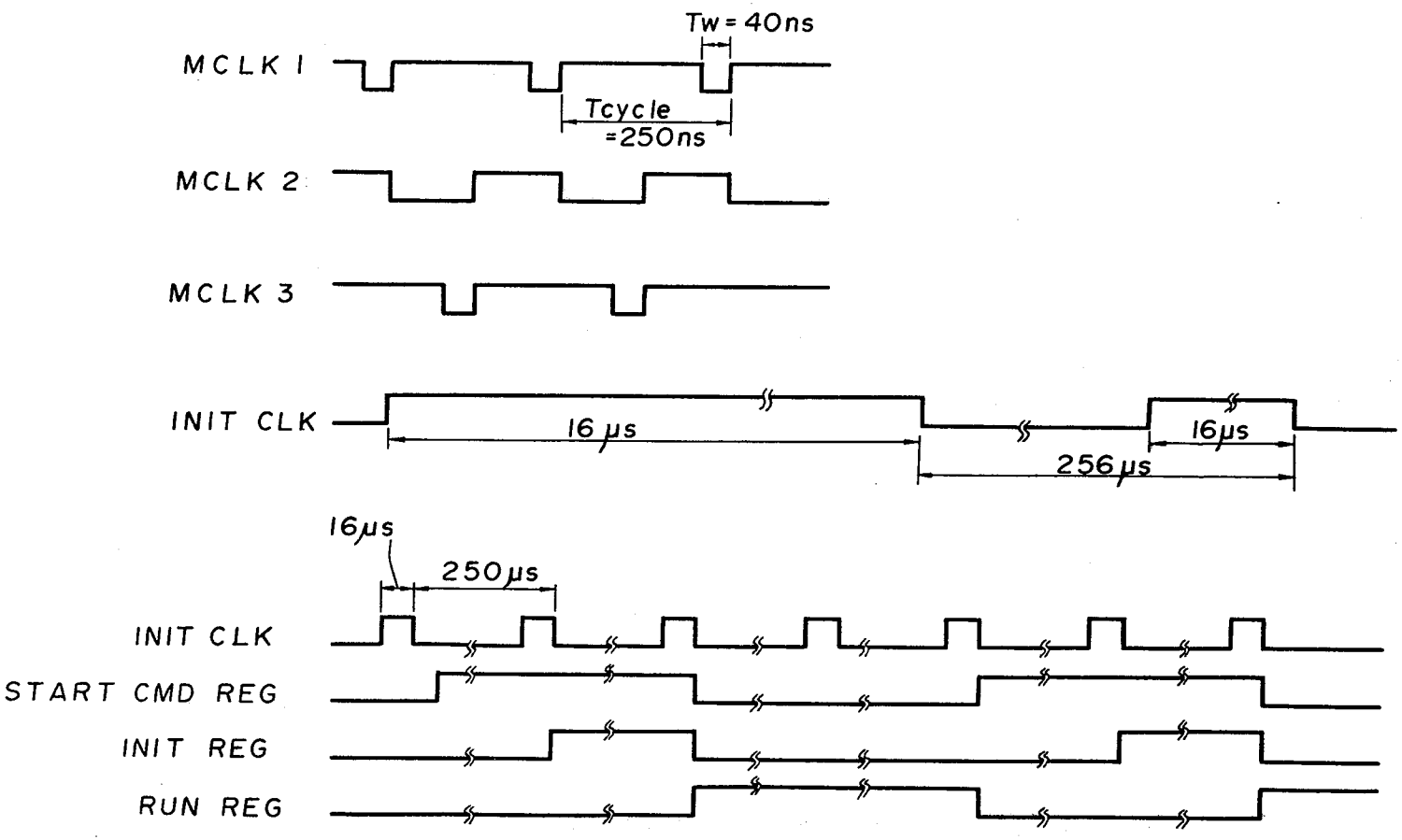
FIG. 3 is a waveform diagram showing various clock pulses employed in the embodiment.

Now, the arrangement of the control circuit shown in FIG. 4 will be described with reference to FIG. 3 also. As was described, before, the assigner and the wave generator in the electronic organ operates in asynchronization with each other. Therefore, in the case when various data are delivered from the assigner through the data bus 18 to the wave generator, it is necessary to deliver the data in synchronization with the operation of the wave generator. For this purpose, a 16-bit start command register 30 is connected to the data bus 18, and two signals INIT and RUN are formed from the output of the register 30 so as to read the data in synchronization with the operation of the wave generator.

A 16-bit INIT register 31, a 16-bit RUN register 32, and a 16-bit bus driver 33 are successively connected to the start command register 30, which operates to supply the data in a parallel mode to the following stages. The registers 31 and 32 are driven by the clock INIT CLK having a cycle of 256 μs. Data representative of a channel employed for waveform calculation in the next step is applied to the start command register 30 by the assigner. In this example, if a bit <N> of the register 30 is "1" (or an on-bit), the waveform calculation is conducted in the channel corresponding to this bit <N>, and during 256 μs waveform calculation parameters for this channel are controlled by an INIT signal described later and are introduced to the memories ENV FREQ INC MEMORY 66 and 67 and the accumulators 54 through 56, and the memory ENV CNT MEMORY 76 from the data ports 11, 13 and 15. The parallel data of the INIT register 31 are simultaneously applied to the RUN register 32 and an INIT multiplexer 34 which is driven by channel addresses 3-0 having a period of 16 μs. The parallel data thus applied to the INIT multiplexer 34 are read as series data sequentially out of the multiplexer 34, and are applied, for instance, to the set input terminal of a flip-flop 37. An output signal provided through the set output terminal of the flip-flop circuit 37 in this operation will be referred to as an INIT signal, which is utilized as a control signal in transferring the above-described waveform calculation parameters. The parallel data of the RUN registers 32 are simultaneously applied to the bus driver 33 and a RUN multiplexer 35. This multiplexer 35, being driven by the channel addresses 3-0, reads out the inputted parallel data as series data and applies it to the reset input terminal of the flip-flop circuit 37. An output signal provided through the reset output terminal of the flip-flop circuit 37 in this operation is referred to as a RUN signal, which is employed for control in transferring the waveform calculation parameters similarly as in the case of the INIT signal. The flip-flop circuit 37 is driven by the master clock $MCLK_1$ whereby the output signals INIT and RUN thereof are delayed by one cycle (250 μs) by these input signals (designated by INIT-1 and RUN-1 in FIG. 4). (In this connection, the suffix "−1" is intended to means that the phase leads by one cycle, which the suffix "+1" is intended to mean that the phase lags by one cycle.) The output of the RUN register 32 is applied to the reset terminals of the start command register 30 and of the INIT register 31 through an inverter 36. Accordingly, when the contents of the INIT register 31 are transferred to the RUN register 32, the "1" signal of the N bit is changed to a "0" signal through the inverter 36. This signal "0" is applied the reset terminals of the two registers 30 and 31 thereby to clear and inhibit the contents of the registers 30 and 31. In this operation, the waveform calculation of a channel corresponding to the N bit is started. Upon completion of the waveform calculation of the channel, a signal STATUS FLAG CLR outputted by an addressable latch circuit 28 described later is applied to the reset terminal of the register 32 to clear the contents of the latter 32. As a result, the inhibit states of the two registers 30 and 31 are released to be ready for the waveform calculation of the following channel. Thus, the process of waveform calculation for a channel from start to end is effected through (1) access of the start command register 30, (2) INIT state, (3) RUN state, and (4) clear of the RUN register 32.

The contents of the RUN register 32 indicate a channel the waveform calculation for which is being conducted. Accordingly, the register 32 can be used as a busy status register which will indicate the status of use of channels. Therefore, the contents of the register 32 are transferred through the bus driver 33 and the data bus 18 to the assigner, where a channel assignment table is formed in the RAM according to the contents thus formed.

When an instruction for shifting sustain-state waveform calculation to decay-state or damp-state waveform calculation is issued from the assigner during the waveform calculation of a channel, this instruction is applied to a decay command register 38 or a damp command register 42 through the data bus 18 so as to cause a relevant N bit to have the on-bit. A decay register 39 driven by the clock pulse INIT CLK is connected to the register 38. The parallel data from the register 38 are applied through this decay register 39 to a decay multiplexer 40. The decay multiplexer 40 is driven by the signals CHANNEL ADDRESS 3-0 to output the inputted parallel data as series data to a register 41. This register 41 outputs the aforementioned data by being driven by the master clock pulse $MCLK_1$. The output signal of the register 41 will be referred to as a signal DECAY. This signal DECAY is employed to shift the state of the waveform from sustain-state to decay-state. The output of the decay register 39 is applied through an inverter 45 to the reset terminal of the decay command register 38, while the above-described signal STATUS FLAG CLR is applied to the reset terminal of the decay register 39. Therefore, when the contents of the decay command register 38 are transferred to the decay register 39, the contents of the register 38 are cleared and inhibited, and the waveform calculation for the above-described channel is shifted to that of decay state. Upon completion of the waveform calculation, the contents of the register 39 are cleared to be ready for the next channel.

Similarly as in the above-described case, a damp register 43 is connected to the damp command register 42. The parallel data outputted by the damp register 43 is applied to a damp multiplexer 44. The damp multiplexer 44, being driven by the signals CHANNEL ADDRESS 3-0, outputs the inputter parallel data as series data and applies the series data thus outputted to the above-described register 41. An output signal provided by the register 41 in this operation will be referred to as a signal DAMP. The output of the damp register 43 is applied through an inverter 46 to the reset terminal of the damp command register 42, while the signal STATUS FLAG CLR has been applied to the reset terminal of the damp register 43. Therefore, when an instruction DAMP is issued by the assigner, the relevant N bit of the damp command register 42 has the on-bit and a signal DAMP is issued. As a result, the waveform in sustain state being calculated is abruptly damped.

Described below is a control circuit for controlling a memory adapted to store combinations between musical tone waveforms being calculated in the channels and the segments.

A segment memory 22 has a storage capacity of 16 w×4 bit, and operates to store the segment of a channel inputted in an address designated by signals CHANNEL ADDRESS 3-0. A latch circuit 23, and a register 24 are successively connected to the segment memory 22. The output of the register 24 is applied to the input terminal B of an adder 25, the output of which is, in turn, applied to the segment memory 22 through an AND gate 26 which is controlled by the signal RUN. The latch circuit 23 is controlled by the signal READ ENV CNT-1. This signal READ ENV CNT-1 is to read the contents of an envelope count memory (or ENV CNT MEMORY) 76 described later, and it is a signal one cycle before the above-described microinstruction READ ENV CNT. The register 24 is driven by the master clock pulse $MCLK_1$. An overflow signal ENV CNT CARRY of an adder 78 in an envelope counter described later is applied to the input terminal CI of the adder 25. Whenever this overflow signal is applied to the adder 25, the content of the adder 25 is increased by +1 and the contents of the segment memory 22 are also increased, as a result of which the fact that the waveform of the next segment is being calculated is stored. On the other hand, as the AND gate 26 is controlled by the signal RUN, the contents of the segment of a channel stored in an address in the segment memory 22 always start with "0", being "7" in maximum.

When the above-described signal DECAY or DAMP is provided during the waveform calculation, it is necessary to increase the contents of the segment memory 22 by 2 and more at a time. It is assumed that the envelope of a waveform is divided into eight segments, and that the segments 0, 1 and 2, the segments 3 and 4, and the segments 5, 6 and 7 are assigned to an attack state, a sustain state, and a decay state, respectively. In this example, when in the state of the segment 3 or 4 the signal DECAY or DAMP is provided, the contents of the segment memory 22 is increased by +2 or +1, and the state of the segment is shifted to one of the states of the segments 5, 6 and 7. Upon application of the above-described signal, a decay request (DECAY REQ) signal or a damp request (DAMP REQ) signal is produced. These signals DECAY REQ and DAMP REQ are introduced into an envelope and frequency generating circuit described later to control an envelope counter or a rate counter. For this purpose, a decay and damp control circuit 29 is provided. The output of the register 24, the signal DECAY, and the signal DAMP are applied to the control circuit 29. If in this operation the output of the register 24 is "3" (or the input signal at the input terminal B of the adder 25 is "3"), a value 2 is outputted by the control circuit 29 and is applied to the input terminal A of the adder 25 when the signal DECAY or DAMP is applied to the control circuit 29. As a result, the adder 25 calculates $2+3=5$. This resultant value 5 is applied through the AND gate 26 to the segment memory 22 where it is stored in the address of a relevant channel, that is, the fact that the waveform of the segment 5 is being calculated is stored. Similarly, if a value "4" is applied to the input terminal B of the adder 25, a calculation $(4+1=5)$ is performed.

Whenever in waveform calculation for each channel the segment is advanced as described above, the contents of the segment of a relevant channel in the segment memory 22 is renewed to indicate a segment being calculated at present. This segment is latched by the latch circuit 23 and is stored in the register 24, so as to be ready for the next calculation in the adder 25.

Now, a circuit forming a pipelined segment address (PLD SEG ADRS) signal will be described which is employed in reading the contents of memories ENV FREQ INC MEMORY 66 and 67 and a memory ENV CNT MEMORY 76 described later.

The output of the latch circuit 23 is applied to the input terminal A of a selector register 21, while the signals INIT SEG ADRS 2-0 provided by the master counter 2 are applied to the input terminal B of the same. The selector register 21 is driven by the signal INIT-1 or the master clock pulse $MCLK_1$. Accordingly, when a waveform calculation channel is in an INIT state, the selector register 21 is driven by the signal INIT-1 to selectively output the signals INIT SEG ADRS 2-0. When the waveform calculation channel is in a RUN state, the selector register 21 is driven by the signal $MCLK_1$ to output the contents of the above-described segment memory 22. Thus, different addresses are provided separately according to the INIT state and the RUN state by the selector register 21. These output signals will be referred to as "pipelined segment address" (PLD SEG ADRS) 2-0.

In this example, the waveform calculation is accomplished when the envelope has a negative value, or when the contents of the segment memory 22 are changed from "7" to "8". The fact that the envelope has a negative value is detected from the contents of a selector register 51 (FIG. 5) described later. In this operation, a signal RUN END REQ is outputted, and it is applied through an OR gate 27 to an addressable latch circuit 28 where it is stored. Furthermore, the fact that the contents of the segment memory 22 have "8" is detected from the output of the register 24. The output provided by the register 24 in this operation is referred to as a signal RUN SEG 3. This signal RUN SEG 3 is also applied through the OR gate 27 to the latch circuit 28, when it is stored. The addressable latch circuit 28 is driven by the signals CHANNEL ADDRESS 3-0 to output the above-described signal STATUS FLAG CLR. By this signal all of the above-described registers 32, 39 and 43 are cleared. When the waveform calculation of a channel is completed, the completion signal is applied, as an interruption request signal, to the assigner, and the assigner carries out a process for employing the channel for a request for an other key.

Figure 5:
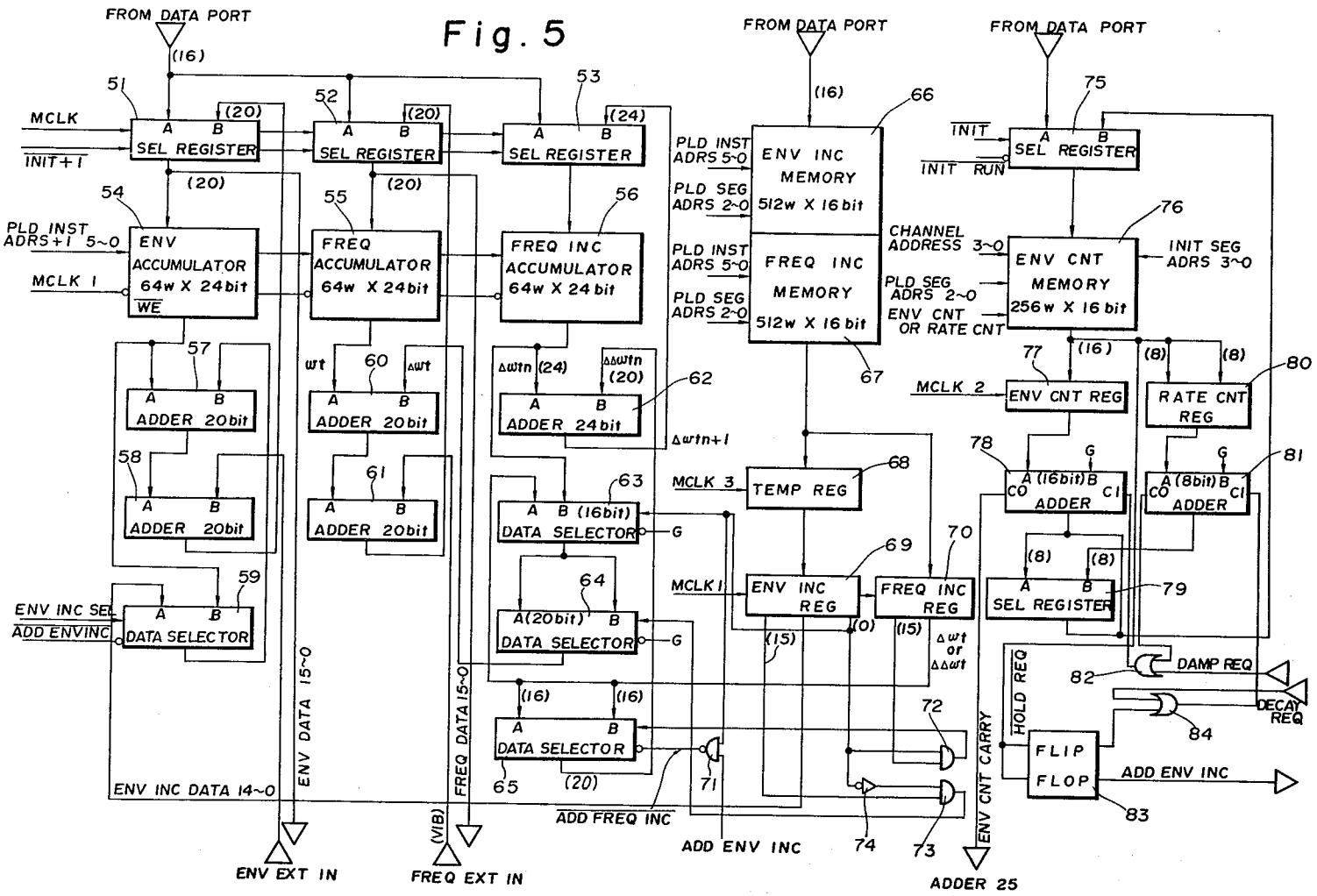
FIG. 5 is also a block diagram illustrating an arrangement of the envelope and frequency generating circuit in the embodiment.

The arrangement of the envelope and frequency generating circuits will be described with reference to FIG. 5. In this circuit, the initial values of a frequency and an envelope for waveform calculation of a channel which are applied from the above-described data ports shown in FIG. 2 are added to the increment values thereof so that frequency and envelope data for waveform calculation for each channel are formed, and the data are delivered in the arithmetic operation circuit shown in FIG. 6 where they are subjected to calculation. The envelope and frequency generating circuits described above includes a circuit capable of controlling the time intervals of the segments.

A 20-bit selector register 51 is driven by the master clock pulse as a load signal and by a signal $\overline{\text{INIT}+1}$ as a selection signal so as to selectively store the envelope initial value INIT ACC DATA 15-0 applied to its input terminal A from the INIT ENV FREQ DATA PORT 13, or the output of an adder 58 (described later) applied to its input terminal B. The signal $\overline{\text{INIT}+1}$ is the inverted signal of the signal INIT+1 described before. As this signal $\overline{\text{INIT}+1}$ is outputted when the waveform calculation of a channel is started, the selector register 51 is driven by the master clock pulse $MCLK_3$ during the initial period of waveform calculation thereby to store the above-described initial value INIT ACC DATA 15-0, and is thereafter controlled by the signal INIT+1 so as to store the output of the adder 58. The output data of the selector register 51 is stored in a relevant address of an envelope accumulator 54 having a storage capacity of 64 w×20 bit, and out of the output data the sixteen higher bits are delivered, as ENV DATA 15-0, to the arithmetic operation circuit shown in FIG. 6. In the accumulator 54, an address is designated by a signal PLD INIT ADRS+1 5-0 which is repeatedly provided every 16 μs, and the input data is stored by driving the accumulator with the master clock pulse $MCLK_1$. The output of the accumulator 54 is applied to the input terminal A of a 20-bit adder 57, while the output data of a data selector 59 is applied to the input terminal B of the adder 57. The output data ENV INC DATA 14-0 (representative of an envelope increment value) of an ENV INC REG 69 (described later) is applied to the input terminal A of the data selector 59. The (1/128) data which is obtained by complement-shifting the output data of the envelope accumulator 54 by seven (7) bits upon damp request is applied to the input terminal B of the data selector 59. The data selector 59 is controlled by the signal ENV INC SEL or a signal $\overline{\text{ADD ENV INC}}$, whereby either of the above-described data is selectively read out. The output data of the adder 57 is applied to the input terminal A of the adder 58. An external applied data (random number) when required is supplied to the input terminal B of the adder 58. The aforementioned signal ADD ENV INC is provided when a rate count register 80 is overflowed, whereby addition of an envelope increment value for advancement to the next segment is conducted. The abovedescribed adders 57, 58 and data selector 59 form an addition circuit.

In the circuit thus organized, when waveform calculation for a channel is started, first the envelope initial value delivered by the data port 13 is applied to the input terminal A of the selector register 51. This initial value is stored in a designated address in the envelope accumulator 54 through the selector register 51, and is applied to the arithmetic operation circuit (FIG. 6) on the other hand. In this case, a frequency initial value is also applied to the arithmetic operation circuit, whereby arithmetic operation is started. When the signal ADD ENV INC is provided so as to add the increment value to the initial value, the data ENV INC DATA 14-0 representative of the increment value is applied to the input terminal A of the data selector 59. This data is selected and outputted by the selector 59, and is applied to the input terminal B of the adder 57. As the aforementioned initial value has been applied to the input terminal B of the adder 57, and therefore in the adder 57 the increment value is added to the initial value, and the result is applied through the adder 58 to the input terminal B of the selector register 51. Accordingly, the aforementioned result is outputted through the selector register 51 in synchronization with the master clock pulse $MCLK_3$ and is written, as new data, in the accumulator 54. On the other hand, the result is delivered to the arithmetic operation circuit, and arithmetic operation for the next segment is started. In the run state where none of the signal ADD ENV INC and the damp request are available, the data written in the accumulator 54 is applied through the adder 57 to the input terminal A of the adder 58. In the adder 58, the random number applied to the input terminal B thereof is added to the data, and the result of this addition is written in the accumulator 54 on the one hand and is applied to the arithmetic operation circuit 54. In the case where the damp request is provided, the data −(1/128) obtained by complement-shifting by seven bits the data which has been stored in the accumulator 54 is applied to the input terminal B of the data selector 59. In the data selector 59, this data is selected with the aid of the signal ENV INC SEL, and is applied through the adders 57 and 59 to the selector register 51. Therefore, the data is stored in the accumulator 54, while the arithmetic operation circuit receives this data and carries out an arithmetic operation to exponentially reduce the envelope.

Now, the frequency generating circuit having the same arrangement as that of the above-described envelope generating circuit will be described.

A selector register 52 is completely similar in construction to the selector register 51. A phase initial value $\phi$ supplied by the data port 13 is applied to the input terminal A of the selector register 52, and the output data of an adder 61 described later is applied to the input terminal B of the same. The selector register 52 operates to store the initial value $\phi$ at the start of waveform calculation, and to store the output data of the adder 61 which is obtained by adding an increment value $\Delta\omega t$ to the initial value $\phi$, after the start. The output data of the selector 52 is stored in a designated address in a frequency accumulator 55 having a storage capacity 64 w×20 bit, and the sixteen higher bits out of the output data are applied, as FREQ DATA 15-0, to the arithmetic operation circuit. The output data of the accumulator 55 will be represented by $\Delta\omega t$. The data $\omega t$ is applied to the input terminal A of a 20-bit adder 60, while the output data (phase increment value $\Delta\omega t$) of a data selector 64 described later is supplied to the input terminal B of the adder 60. In the adder 60, the two data thus applied are subjected to addition, and the result of the addition is introduced to the input terminal A of a 20-bit adder 61. On the other hand, an externally applied frequency modulation data (vibrato data) VIB is supplied to the input terminal B of the adder 61. Accordingly, the output data of the adder 61 will have a phase instantaneous value ($\omega t+\Delta\omega t+\phi+$VIB). This value is applied through the selector register 52 to the accumulator 55 where it is stored, and is, on the other hand, applied, as the above-described FREQ DATA 15-0, to the arithmetic operation circuit. The above-described adders 60, 61 form an addition circuit. A selector register 53 is completely equal in construction to the abovedescribed selector registers 51 and 52. At the start of waveform calculation, the initial value $\phi'$ of a phase increment value $\Delta\omega t$ is delivered to the input terminal A of the selector register 53 from the data port 13. Similarly as in the above case, this initial value $\phi'$ is stored in a frequency increment value accumulator 56. The storage capacity of the accumulator 56 is 64 w×24 bit. The output $\Delta\omega t$ of the accumulator 56 is applied to the input terminal A of a 24-bit adder 62, and to the input terminal B of a data selector 63. The output $\Delta\Delta\omega t$ of a data selector 65 described later is applied to the input terminal B of the adder 62. Therefore, in the adder 62, the data $\Delta\Delta\omega t$ is added to the data $\Delta\omega t$, as a result of which a new increment value $\Delta\omega t$ is calculated. This new increment value is applied to the input terminal B of the selector register 53 and is then applied to the accumulator 56 where it is stored. The above-described adder 62 and data selectors 63, 64, 65 form an addition circuit.

Now, a control circuit for data selectors 63, 64 and 65 will be described.

The above-described ENV INC MEMORY 66 and FREQ IN MEMORY 67 each having a capacity of 512 w×16 bit, store the data ENV INC DATA and FREQ INC DATA delivered from the data port 11 in addresses designated by the signals PLD INST ADRS 5-0 and PLD SEG ADRS 2-0. In the run state after transfer, the data ENV INC DATA and FREQ INC DATA are sequentially read out every one cycle (256 μs). The data ENV INC DATA is stored in a temporarily storing register 68 driven by the master clock pulse $MCLK_3$, and is then stored in a register ENV INC REG 69 driven by the master clock pulse $MCLK_1$ and is further introduced, as data ENV INC data 14-0, to the above-described data selector 59. On the other hand, the data FREQ INC DATA is stored in a register FREQ INC REG 70 driven by the master clock pulse $MCLK_1$. Out of the aforementioned two data, the <15> bit and <0> bit of the data ENV INC DATA, and the <15> bit of the data FREQ INC DATA are employed as control bits. When the combination of these three control bits is <10×> (where X means "Don't care"), the 20-bit data selector 64 is so controlled that the selected $\Delta\omega t$ is shifted by four bits to be of 1/16. For this purpose, the content of bit <15> of the ENV INC REG 69 is applied to a first input of an AND gate 73, and the content of bit <0> is applied to a second input of the AND gate 73 through an inverter 74, and in addition the output of the AND gate 73 is applied, as a control signal, to the data selector 64. When the aforementioned combination is <X1X>, the data $\Delta\omega tn$ and $\Delta\Delta\omega t$ n are added in the adder 62, and a control signal selecting as $\Delta\omega t$ n+1 is obtained from the result of this addition. This control signal <X1X> is fed to the data selector 66, and data $\Delta\Delta\omega t$ is applied to the input terminal B of the adder 62 by the data selector 65. Thus, the content of bit <0> of the register ENV INC REG 69 and the signal ADD ENV INC (which is delivered from a flip-flop circuit 83 described later) are applied to a NAND gate 71, the output of which is applied, as a control signal $\overline{\text{ADD FREQ INC}}$, to the data selector 65.

When the above-described combination is <X11>, the selected data $\Delta\Delta\omega t$ n stored in the data selector 65 is shifted by 4 bits. Therefore, the content of bit <0> of the register ENV INC REG 69 and the content of bit <15> of the register FREQ INC REG 70 are applied to the AND gate 72 where these contents are subjected to logical production, and the output of the AND gate 72 is introduced, as a control signal, to the data selector 65.

When the content of bit <0> of the register ENV INC REG 69 is "1", the output of the register FREQ INC REG 70 represents $\Delta\Delta\omega t$; and when the content of bit <0> of the register 69 is "0", the output of the register 70 represents $\Delta\omega t$. These outputs are delivered to the input terminals A and B of the 20-bit data selector 65, and to the input terminal A of the 16-bit data selector 63. The output of the data selector 63 is applied through the data selector 64 to the terminal B of the above-described adder 60.

As the frequency generating circuit is organized as described above, arithmetic operation for continuously varying frequency can be readily achieved. Continuous frequency variation can be achieved by continuously varying a phase increment value $\Delta\omega t$. Therefore, the value $\Delta\omega t$ and an increment value $\Delta\Delta\omega t$; for this value $\Delta\omega t$ are applied to the input terminals A and B of the adder 62, where these values are subjected to the following operation: $\Delta\omega t\ n+1=\Delta\omega t\ n+\Delta\Delta\omega t\ n+1$.

This $\Delta\omega t\ n+1$ is applied through the selector register 53 to the accumulator 56, where it is stored. During this arithmetic operation, the following operations are carried out so as to maintain the accuracy of the increment value $\Delta\Delta\omega t$: That is, bit <0> of the register ENV INC REG 69 is raised to "1", while bit <15> of the register FREQ INC REG 70 is also raised to "1", as a result of which the AND gate 72 is opened, and the output of the AND gate 72 is delivered to the 20-bit data selector 65. Therefore, the data selector 65 shifts the data $\Delta\Delta\omega t$ delivered from the register FREQ INC REG 70 by 4 bits to be of 1/16. Then, the data selector 65 is driven by the output signal of the NAND gate 71 which is opened by the signal ADD FREQ INC, so that the data $\Delta\Delta\omega t$ shifted by four bits is outputted by the data selector 65 is delivered to the input terminal B of the adder 62. Thus, the output $\Delta\omega t\ n+1$ of the accumulator 56 is varied continuously in proportion to the lapse of time, and is applied to the input terminal B of the adder 60 through the data selectors 63 and 64.

In the case where it is unnecessary vary the frequency, the above-described arithmetic operation is not carried out. That is, the output data $\Delta\omega t$ of the register FREQ INC REG 70 is selected and delivered to the input terminal A of the data selector 63, and to the adder 60 through the data selector 64. In this case, in order to maintain the accuracy of the data $\Delta\omega t$, the two control bits <15> and <0> become "1" and "0", respectively, to provide an output signal from the AND gate 73. This output signal is applied to the data selector 64, so that the aforementioned data $\Delta\omega t$ applied to the data selector 64 is shifted by four bits and is then applied to the adder 60.

The arrangement of a circuit adapted to control the time interval of segments will be described hereinafter. As was described before, in this example the envelope of a waveform is divided into eight (8) segments which are connected by straight lines for approximation calculation.

As conducive to a full understanding of the following description, examples of envelope count data and rate count data (of. tables below) and the fundamental operations according to these data will be described.

| | ENV CNT DATA 16 bits | |
|---|---|---|
| Segment | LSD | MSD |
| 0 | 00010101 | |
| 1 | 11010101 | |
| 2 | 10101001 | |
| 3 | 111110100101 | |
| 4 | 111110100101 | |
| 5 | 011010101001 | |
| 6 | 1011101010101 | |
| 7 | 11011011011101 | |

| | RATE CNT DATA | |
|---|---|---|
| Segment | 8 bits for restoring | 8 bits |
| 0 | | 10101 |
| 1 | | 011001 |
| 2 | | 00100101 |
| 3 | | 01001 |
| 4 | | 01001 |
| 5 | | 00000101 |

-continued

| | RATE CNT DATA | |
|---|---|---|
| Segment | 8 bits for restoring | 8 bits |
| 6 | | 00000101 |
| 7 | | 00000101 |

In the above example, when a channel is in INIT state, 16-bit envelope count data representative of initial values for segments 0 through 7 (for instance "168" in decimal notation for segment (0) are read out of the data port 15. Simultaneously, 16-bit rate count data (for instance "21" in decimal notation for segment (0) for all segments 0 through 7 are also read out. In the eight lower bits of the 16-bit rate count data, the aforementioned data (21) for instance in the case of segment 0 is stored during the waveform calculation. Furthermore, when the data (21) is successively reduced to (20), (19), . . . (0) through subtraction by one (−1), these data (20), (19), . . . (0) are stored in the eight higher bits of the rate count data. When data (0) is detected by successively subtracting one (−1) from the rate count data, for instance in the case of segment 0 the envelope count data (168) is successively reduced to (167), (166), . . . (0) through subtraction by one (−1), and at this (0) the waveform calculation for segment 0 is completed. When the envelope count data is successively reduced through subtraction by one (−1), a signal ADD ENV INC is outputted.

In the following description, the envelope count data and the rate count data are read, as 2's complement signals, out of the data port 15. Therefore, both data are subjected to addition by one (+1) instead of the above-described subtract by one (−1).

The initial value INIT ENV CNT DATA 15-0 in 2's complement of the envelope count data delivered from the data port 15 is applied to the input terminal A of a selector register 75 and to the input terminal B of which the output of a selector register 79 (described later) or the output of an adder 78 is applied. The selector register 75 is controlled by a signal $\overline{\text{INIT}}$ or $\overline{\text{INIT}+\text{RUN}}$ to selectively store one of the data applied to the input terminals A and B thereof and thereafter to store these data in an envelope count memory ENV CNT MEMORY 76. This memory 76 has addresses of eight bits for CHANNEL ADDRESS 3-0, PLD SEG ADRS 2-0, and one bit for distinguishing an envelope count and a rate count from each other, which are applied as address inputs, the storage capacity of the memory 76 being 256 w×16 bit.

The envelope count data provided by the memory 76 is stored in a register ENV CNT REG 77 driven by the master clock pulse $MCLK_2$, and the output of the register 77 is applied to the input terminal A of a 16-bit adder 78. The aforementioned envelope count data includes the initial value for each segment of the envelope given to the waveform being calculated. Therefore, the envelope count data is inputted to the register 77 when the waveform calculation of a segment is started. When the signal DAMP REQ is provided, and when carry takes place in an 8-bit adder 81 described later, these signals is introduced to the input terminal CI of an adder 78 through an OR gate 82, where addition of +1 is effected. The eight higher bits out of the output of the adder 78 are applied through a select register 79 to the input terminal B of the selector register 75, while the eight lower bits are applied directly to the input terminal B of the selector register 75, whereby these bits are stored in the respective addresses in the memory 76 again. On the other hand, when carry takes place in the adder 78, the carry is delivered, as a signal ENV CNT CARRY, to the above-described adder 25 (FIG. 4), and one (+1) is added to the contents of the segment memory 22.

The rate count data read out of the memory 76 in succession with the envelope count data is stored in a rate count register (RATE CNT REG) 80. This rate count data is to specify the time intervals at which the content of the envelope count data is successively increased by +1, respectively for the segments. Thus, during the waveform calculation for a segment, the envelope count data is increased successively by +1 at the time intervals specified by the rate count data. Accordingly, the content of the register 80 is delivered to an 8-bit adder 81. In this adder 81, when a decay request (DECAY REQ) is provided, or when a hold request (HOLD REQ) is not provided, the rate count data is increased by +1. The hold request is a signal to suspend the increment operation of the rate count register 80, that is, a signal to inhibit the increment of the rate count data in the adder 81. This signal is included in the bit <7> (the 7th bit) of the rate count data. Upon provision of the hold request signal, addition of the rate count data in the adder is suspended, and accordingly the content of the adder 78 is maintained unchanged. As a result, advancement of the segment is stopped, and the waveform calculation for one and the same segment is repeatedly carried out. For this purpose, the inverted signal ($\overline{\text{HOLD REQ}}$) of the rate count data <7> is applied to the input terminal CI of the adder 81 through a flip-flop circuit 83 (provided for timing operation) and an OR gate 84. The decay request signal is also applied to the input terminal CI of the adder 81 through the OR gate 84. Therefore, when the hold request is not provided, or when the decay request is provided, the rate count data is increased by +1 every predetermined sampling period of time (16 μs). On the other hand, the state in which the addition operation of the adder 81 is suspended by the hold request signal and the same waveform calculation is repeated, is released when the aforementioned decay request signal is outputted. In this connection, the above-described signal ADD ENV INC is outputted by the flip-flop circuit 83 so as to be employed as a control signal for the data selector 59.

After selectively stored in the selector register 79, the output of the adder 81 is stored in the memory 76 through the selector register 75 again. When carry takes place in the adder 81, the bit in this operation is stored, as control data, in the memory 76 simultaneously. When this bit is read out in the next period, the first value of the rate count data is selected and is read out of the above-described data port 15. The first value is stored in the rate count register 80, and simultaneously the signal ADD ENV INC is outputted, as a result of which the envelope increment value is added to the value at the preceding sampling point.

The above-described adder 81, flip-flop circuit 83, OR gate 84 form a first control circuit, and the adder 78 and OR gate 82 form a second control circuit.

As the segment time interval control circuit is organized as described above, in the INIT state of a channel, the envelope count data initial values for all segments of the waveform envelope and the rate count data for all the segments are transferred to the selector register 75 from the data port 15 and are then stored in the memory 76. When the waveform calculation is started, these data are stored in the envelope count register 77 and the rate count register 80. When the hold request is not provided, or when the decay request is provided, in the 8-bit adder 80 the content thereof is increased by +1 at time intervals specified by predetermined sampling time. Whenever carry takes place in the adder 80, or when the damp request is provided, the content of the 16-bit adder 78 is increased by +1. If the hold request is provided during this calculation the operation of the adder 81 is suspended, and the waveform calculation which has been conducted is continued until the next decay request is issued. Accordingly, in this case, the segment will not advance to the next. When carry takes place in the adder 78, the waveform calculation for the first segment is completed, and the waveform calculation for the next segment is started, in which the increment value of the second segment is added to the final value of the envelope for the first segment. Furthermore, the content of the segment memory 22 is increased by +1 by the signal ENV CNT CARRY caused by the carry of the adder 78, that is, the segment memory 22 stores the fact that the calculation of the second segment is being performed in the channel. Thus, as the time intervals of waveform calculation for the segments are determined by the envelope count data and the rate count data, calculation time for the segment can be freely changed by controlling the operations of the adders 78 and 81.

Now, the arrangement of the arithmetic operation circuit (or waveform calculation circuit) will be described with reference to FIG. 6. This circuit receives the envelope data and frequency data formed by the envelope and frequency generating circuits described with reference to FIG. 5, so as to calculate waveform sample values for every segment described above in a time division system.

The arithmetic operation circuit fundamentally comprises 16-bit registers, 16-bit adders, a 16-bit sine table, a 16-bit×16-bit 2's complement multiplier, and auxiliary gate circuits. The circuit can be, in general, used for calculation according to the following Equation (1):

$$y = \sum_{i=1}^{n} A_i \sin\left\{ \omega_i t + \sum_{j=1}^{m} I_j \sin\left( \sum_{k=1}^{e} L_k \operatorname{Sin} \omega kt + \omega jt \right)\right\} \quad (1)$$

The calculation sequence of Equation (1) is controlled by a microinstruction outputted by the above-described microprogram memory 47, and can be changed by changing the contents of the microprogram memory 47. The microinstruction is read with an instruction address (INST ADRS) 5-0 with 64 machine cycle as one period ($64\times256\ n^s=16\ \mu s$) out of the memory 47. However, if various elements forming the arithmetic operation circuit are pipeline-controlled, calculation can be performed most effectively, and a plurality of waveform sample values can be simultaneously calculated in a time division system during one period.

The above-described envelope data is inputted to a register 1 (the arithmetic operation circuit is provided with registers 1 through 6; however, these registers are not designated by the serial reference numbers employed in the accompanying drawings) and is the stored by being loaded by a microinstruction LD REG 1. A register 2 is connected to the register 1, the register 2 being loaded by a microinstruction LD REG 2. When the content of the register 1 is transferred to the register 2, the register 2 operates to store it and to deliver it to a multiplier 90. The frequency data is applied to the input terminal A of an adder 95 or to a register 3 loaded by microinstructions FREQ SEL and LD REG 3, and is stored therein. The content of the register 3 is transferred to a sine table 96, so as to provide a corresponding sine function value, and the result is stored in a register 4 loaded by a microinstruction LD REG 4. In the multiplier 90, a predetermined calculation is performed by receiving the contents of the registers 2 and 4, and the calculation result is applied to the input terminal B of an adder 91. The calculation result of the adder 91 is applied to a register 5 which is connected to the adder 91 and loaded by a microinstruction LD REG 5, and to the input terminal B of the adder 95. In other words, an intermediate result of calculation in the multiplier 90 is applied to the input terminal B of the adder 95, in which this intermediate result is added to an new frequency data delivered from the frequency generating circuit shown in FIG. 5, and the result of this addition is applied to the register 3 and is stored therein. The addition result stored in the register 3 is delivered to the sine table 96, whereby the corresponding data is read out and is stored in the register 4. Furthermore, the content of the register 5 is applied to the input terminal A of the adder 91 through a gate circuit 92 which is controlled by a microinstruction GATE MULK. As a result, in the adder 91, the calculation result applied to its input terminal A is added to the calculation result performed by the multiplier 90, and the result of this addition is applied to the register 5 or the adder 95. The final calculation result is applied from the register 5 to an output buffer 93. The output buffer 93 operates to store the above-described calculation result by being loaded by a microinstruction LD OUT BUF, and the content of the output buffer 93 is applied to a digital-to-analog (D-A) converter 94, where it is converted into an analog data.

The above-described sine table 96 receives a 16-bit address input data to output a 16-bit corresponding thereto. This sine table is made up of a read only memory (ROM) with a storage capacity of 512 w×16-bit which has store $\frac{1}{4}$ sinusoidal waveforms, a road only memory with a storage capacity of 512 w×8bit which has stored $\frac{1}{4}$ cosine waveforms, a multiplier of 5 bit×8 bit, and a 2's complementer, so as to carry out arithmetic operation in an interpolation system. However, it is possible to provide a plurality of optional function table instead of the sine table. In this case, these tables are selectively employed with the aid of microinstructions from the microprogram memory 47.

An actual waveform calculation according to the following Equation (2) will be described with reference to FIGS. 7 and 8, by way of example.

$$y=A \sin(\omega t+I_1 \sin \omega_1+I_2 \sin \omega_2 t) \quad (2)$$

For calculation of Equation (2) four machine cycles are necessary, and in the microprogram memory 47,64 machine cycles correspond to its one period. Therefore, sixteen (16) sample values can be calculated within one period. FIG. 7 indicates the steps of calculation of Equation (2). FIG. 8 indicates the states of microinstructions read out of the memory 47 during this calculation.

It is assumed that a key of the electronic organ is depressed, necessary data processing is carried out by the assigner, and the data are delivered to the data ports 11,13 and 15 and are loadable in empty channels of the wave generator.

Then, at the time instant $T_0$, a microinstruction READ ENV CNT is outputted in order to read the initial value of the envelope count data out of the data port 15.

Time instant $T_1$:

At time instant $T_1$, the data $I_1$, $\Delta I_1$, $\omega_1 t$ and $\Delta\omega_1 t$ are read out of the envelope accumulator 54, the memory ENV INC MEMORY 66, the frequency accumulator 55, and the memory FREQ INC MEMORY 67, respectively. These data are subjected to arithmetic operations of $(I_1+\Delta I_1)$ and $(\omega_1 t+\Delta\omega_1 t)$ in the envelope and frequency generating circuits, and the resultant data are applied to the registers 1 and 3, respectively.

Time instant $T_2$:

Microinstructions LD REG 1 and LD REG 3 are outputted, so that the data $(I_1+\Delta I_1)$ and $(\omega_1 t+\Delta\omega_1 t)$ are loaded and stored in the registers 1 and 3, respectively. Simultaneously the data $I_2$, $I_2$, 107 $_2$t, and $\Delta\omega_2 t$ are read out of the envelope accumulator 54, etc. so that calculations $(I_2+\Delta I_2)$ and $(\omega_2 t+\Delta\omega_2 t)$ are performed in the envelope and frequency generating circuits, and the results of these calculations are applied to the registers 1 and 3, respectively.

Time instant $T_3$:

Microinstructions LD REG 2 and LD REG 4 are provided, so that the content $(I_1+\Delta I_1)$ of the register 1 is applied to the register 2, while the content of the register 3 is applied to the sine table 96, whereby the data $\sin(\omega_1 t+\Delta\omega_1 t)$ is read out, and it is loaded and stored in the register 4. Furthermore, microinstructions LD REG 1 and LD REG 3 are outputted, so that the data $(I_2+\Delta I_2)$ and $(\omega_2 t+\Delta\omega_2 t)$ are loaded and stored in the registers 1 and 2, respectively. Moreover, a microinstruction READ Av is provided, so that envelope values Av and ΔAv employed for a vibrato effect are read out of the accumulator 54 and the memory 66, and a calculation (Av+ΔAv) is performed.

Time instant $T_4$:

In the multiplier 90, the content of the register 2 is multiplied by the content of the register 4, and the product thereof, that is, $(I_1+\Delta I_1)\sin(\omega_1 t+\Delta\omega_1 t)$ is stored in the register 4 by being loaded by a microinstruction LD REG 5 outputted. The content $(I_2+\Delta I_2)$ of the register 1 is transferred to the register 2, where it is stored in response to the microinstruction LD REG 2. A value corresponding to the content $(\omega_2 t+\Delta\omega_2 t)$ of the register 3 is read out of the sine table 96, and the data $\sin(\omega_2 t+\Delta\omega_2 t)$ is stored in the register 4 by being loaded by the microinstruction LD REG 4. Simultaneously, the data A, ΔA, ωt, and Δωt are read out of the envelope accumulator 54, etc., and calculations (A+ΔA) and (ωt+Δωt) are carried out. The data (ωt+Δωt) is applied to the register 3 in response to a microinstruction FREQ SEL. A microinstruction GATE MUL K is provided so as to open the gate circuit 92, as a result of which the content $(I_1+\Delta I_1)\sin(\omega_1+\Delta\omega_1 t)$ is applied to the input terminal A of the adder 91.

Time instant $T_5$:

In response to a microinstruction LD REG 1, the data (A+ΔA) is loaded and stored in the register 1. The content of the register 2 and the content of the register 4 are subjected to multiplication in the multiplier 90, and the result of this multiplication, that is, $(I_2+\Delta I_2)\sin(\omega_2 t+\Delta\omega_2 t)$ is delivered to the input terminal B of the adder 91. In this case, in the adder 91 the data applied to its input terminals A and B are subjected to addition, and the result of this addition, that is, $(I_1+\Delta I_1)\sin(\omega_1 t+\Delta\omega_1 t)+(I_2+\Delta I_2)\sin(\omega_2 t+\Delta\omega_2 t)$ is delivered to the adder 95. At the same time, a microinstruction LD REG 3 is provided, so that the following data is stored:

$$(I_1+\Delta I_1)\sin(\omega_1 t+\Delta\omega_1 t)+\omega t+\Delta\omega t$$

Figure 6:
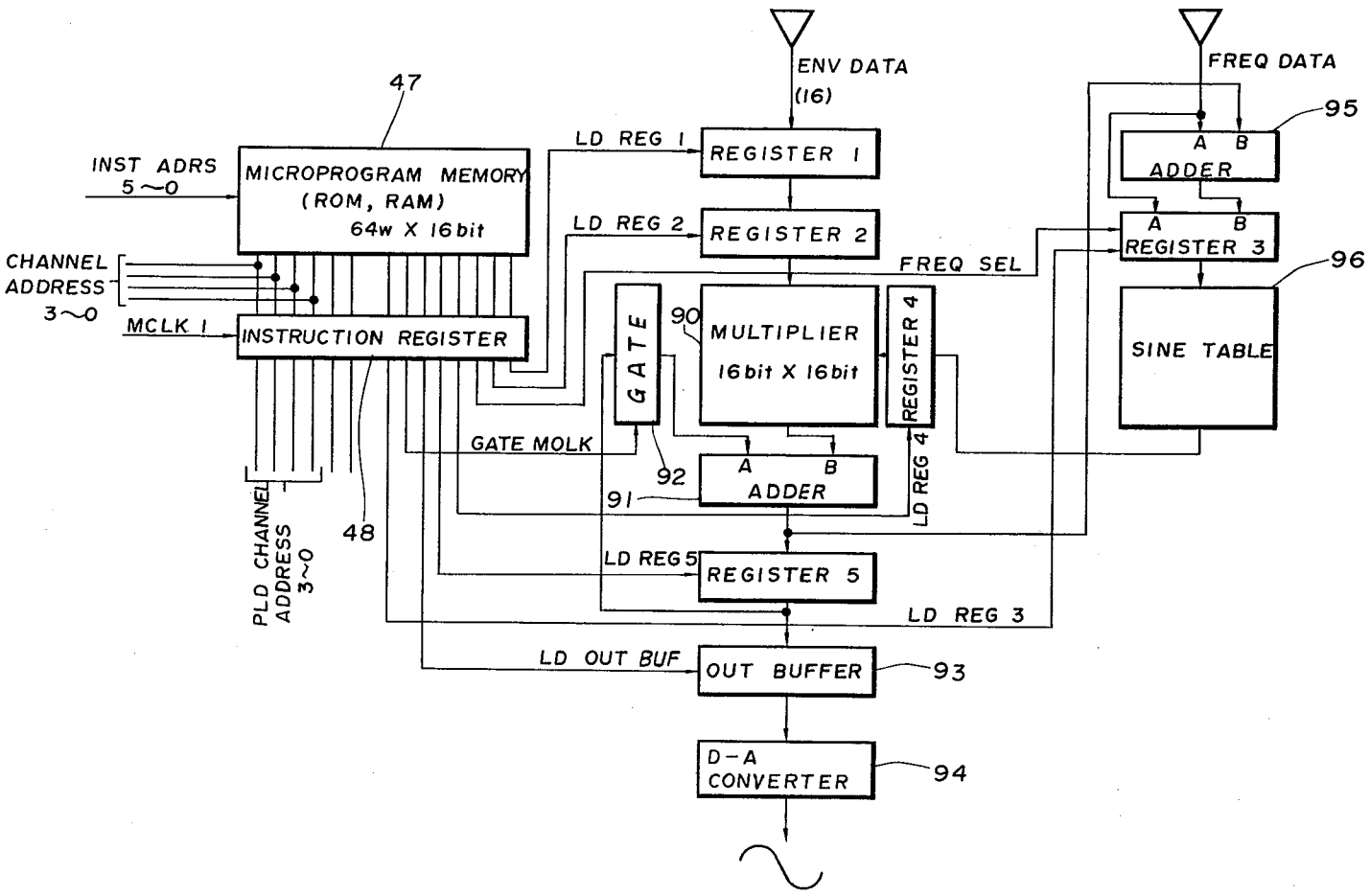
FIG. 6 is a block diagram showing an arithmetic operation (waveform calculation) circuit in the embodiment.

In this example, the arithmetic operation circuit shown in FIG. 6 carries out the waveform calculation by pipeline control employing microinstructions. Therefore, waveform calculation parameters for other channels on request are read out to start calculation at this time instant $T_5$.

Time instant $T_6$:

A microinstruction LD REG 2 is provided, so that the data $(A+\Delta A)$ is loaded in the register 2, and data corresponding to the content of the register 3 is read out of the sine table 96. At the same, a microinstruction LD REG 4 is outputted so as to store the following data in the register 4.

$$\sin[\omega t+\Delta\omega t+(I_1+\Delta I_1)\sin(\omega_1 t+\Delta\omega_1 t)+(I_2+\Delta I_2)\sin(\omega_2 t+\Delta\omega_2 t)]$$

Time instant $T_7$:

When the content $(A+\Delta A)$ of the register 2 is changed to a new envelope value A, the content A of the register 2 is multiplied by the content of the register 4 in the multiplier 90, and the result of its addition is applied to the register 5 through the adder 91, and is stored in the register 5 by being loaded by a microinstruction LD REG 5 outputted in this operation. The content of the register 5 will have the following data:

$$A\sin[\omega t+\Delta\omega t+(I_1+\Delta I_1)\sin(\omega_1 t+\Delta\omega_1 t)+(I_2+\Delta I_2)\sin(\omega_2 t+\Delta\omega_2 t)]$$

Time instant $T_8$:

A microinstruction LD OUT BUF is outputted, so as to transfer the above-described data stored in the register 5 to the output buffer 93, whereupon the D-A converter starts to convert the data into an analog signal. At this time instant, a series of waveform calculations for one sample value is completed, and the above-described channel used is now employed as an idle channel for calculation of another sample value.

As was described above, the pipeline control employing microprograms is effected in the arithmetic operation circuit according to this invention. Therefore, it is possible to select a calculation formula most suitable for expression of musical tones. In addition, it is also one of the merits of this invention to be able to calculate a plurality of sample values simultaneously.

Figure 9:
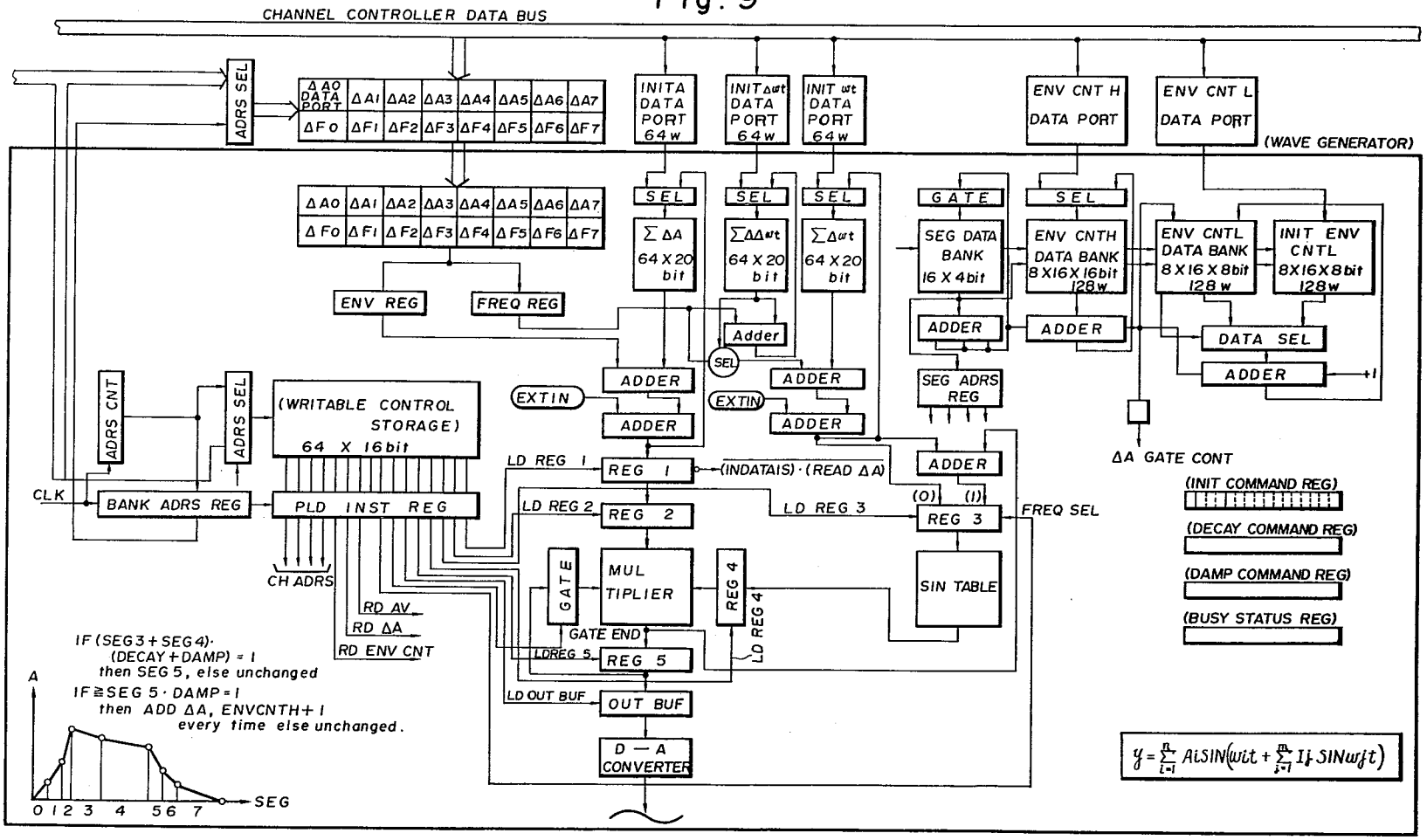
FIG. 9 is a block diagram illustrating the whole arrangement (partially omitted) of the embodiment.

FIG. 9 is a block diagram illustrating the whole arrangement of the above-described wave generator according to this invention. This block diagram does not include all of the circuits which have been described, for simplification; however, it is substantially equivalent.

In the above-described embodiment, the wave generator according to the invention has been applied to the electronic organ; however, it goes without saying that it can be applied to electronic musical instruments other than the electronic organ. Furthermore, in the above-described embodiment, the evenlope of one waveform is divided into eight segments and the waveform calculation is carried out for every segment; however, it should be understood that the number of segments is not limited to eight. In addition, the method of assigning the attack, sustain and decay state of a musical tone waveform to the segments is not limited to that described above.

As is apparent from the above description, according to the invention, the wave generator for an electronic musical instrument comprises the microprogram memory for storing a musical tone calculation sequence which can be changed as desired and for allowing calculation of a plurality of sampling values of a musical tone waveform having a given envelope to be simultaneously carried out in a time division system, an arithemetic circuit which is controlled by the microprogram memory, a plurality of registors for storing frequency data, envelope data or arithmetic intermediate results during the waveform calculation, a function table out of which values corresponding to the inputted frequency data are read, and a multiplier for subjecting a value read out of the function table and an envelope data to multiplication. Therefore, a musical tone waveform calculation sequence can be obtained as desired by changing the contents of the memory, and accordingly a waveform calculating system can be employed in which it is possible to obtain musical tone waveforms close to natural tones most suitable for expression of musical tones. Furthermore, since a plurality of sampling values can be calculated simultaneously, it is possible to carry out waveform calculation at a high rate. There are significant merits of the invention.

Furthermore, according to the invention, an envelope given to a musical tone waveform is divided into plural segments, and phase and envelope increment values are set for every segment, so that in the musical tone waveform calculation the attack, sustain and decay states of the waveform depend on the envelope increment values only, that is, the assignment of the segments to these states can be changed as desired by changing the input data. Therefore, it is possible to set a musical tone waveform for every segment, and intricate musical tone waveforms can be obtained as desired. These features are considerably advantageous for the electronic musical instrument.

In addition, according to the invention, phase increment values and increment values with respect to the phase increment values are set for the above-described segments, respectively, so that a frequency for an optional one of the segments of the waveform can be changed by accumulating these increment values. Therefore, it is possible to change the frequency with time for each segment. As this change of the frequency can be carried out as desired by changing the input data, most suitable musical tones can be obtained freely. This is another merit of the invention suitable for the electronic musical instrument.

Moreover, according to the invention, since the data for setting the time intervals for the segments can be set as desired to carry out the above-described waveform calculation, the time widths of the segments can be changed freely by changing the input data, as a result of which most suitable musical tones can be obtained as desired. This is also one of the significant merits of the invention suitable for the electronic musical instrument.

What is claimed is:

1. A wave generator for an electronic musical instrument, comprising: a microprogram memory for storing a set of instructions, said instructions consisting of instructions for musical tone calculation and for indicating the sequence of calculation of a plurality of sample values constituting a musical tone waveform according to a predetermined calculation formula; an instruction delivery circuit connected to said microprogram memory for delivering said instructions; a data source for generating frequency data and envelope data which respectively designate a tone pitch and a sounding timing of each tone to be produced;

an arithmetic circuit for carrying out waveform calculations under the control of said instructions; a plurality of registers connected to said data source, said instruction delivery circuit and said arithmetic circuit for storing said frequency data, said envelope data, and arithmetic intermediate results which are inputted from said arithmetic circuit during the waveform calculations; and a function table connected to said registers for storing function values at respective addresses and delivering the function values when accessed by said registers under the control of said instructions;

said arithmetic circuit carrying out said calculations using said frequency data, said envelope data and said function values received from said registers and in accordance with said instructions received from said registers;

the calculation results constituting a musical tone wave.

2. A wave generator as claimed in claim 1, in which said instruction delivery circuit is connected to said registers to control said arithmetic circuit to carry out the waveform calculations for obtaining sample values which constitute a musical tone waveform by advancing phase, by dividing an envelope given to said musical tone waveform into a plurality of segments with respect to time, and by setting an envelope increment value and a phase increment value for each of said segments, in accordance with said instructions, speed of the advancement of the phase being determined by said phase increment value in connection with said frequency data and slope of the envelope being determined by said envelope increment value in connection with said envelope data.

3. A wave generator as claimed in claim 2, in which said microprogram memory further provides a sub-increment value for each of said phase increment values for each of said segments, said arithmetic circuit being connected to carry out the calculation of modifying said phase increment for each segment by said sub-increment value timewise sequentially within the calculation for said each segment.

4. A wave generator as claimed in claim 3, which comprises: a value source generating a phase initial value and a phase accumulation value, a selector register connected to said value source for selectively storing said phase initial value and said phase accumulation value applied thereto; an accumulator for storing said phase accumulation value; and an addition circuit in which an output of said accumulator and a phase increment value are subjected to addition to calculate a new phase increment value, means applying said new phase increment to said selector register, so as to change a frequency of said musical tone waveform for a segment of said musical tone waveform, said selector register, accumulator and addition circuit being connected to said plurality of registers.

5. A wave generator as claimed in claim 3, which comprises: a value source generating an initial value of the phase increment value, a sub-increment value for the phase increment value and an accumulated phase increment value, a selector register connected to said value source for selectively storing said initial value of the phase increment value and said accumulated phase increment value applied thereto; an accumulator for storing said accumulated phase increment value; and an addition circuit in which an output of said accumulator and said sub-increment value for the phase increment value are subjected to addition to calculate a new phase increment value which is applied to said selector register, so as to change a frequency of said musical tone waveform for a segment of said musical tone waveform, said selector register, accumulator and addition circuit being connected to said plurality of registers.

6. A wave generator as claimed in claim 2, which further comprises a segment memory connected to said registers and controlled by said microprogram to store a segment indentifying numeral which indicates the segment now being calculated out of said plurality of segments of said musical tone waveform, said numeral being advanced according to the calculation sequence.

7. A wave generator as claimed in claim 6, in which said set of instructions includes a decay instruction, and when said decay instruction is delivered by said instruction delivery circuit to said registers, the content of said segment memory is changed to be representative of a segment corresponding to a decay state of said musical tone waveform.

8. A wave generator as claimed in claim 6, in which said instruction delivery circuit delivers a calculation completion signal of said musical tone waveform from said microprogram memory when said segment identifying numeral reaches a predetermined value, thereby ceasing the calculation.

9. A wave generator as claimed in claim 2, which further comprises: a value source generating an initial value of the envelope; a selector register for selectively storing said initial value of said envelope and an accumulation value of said envelope which are applied thereto; an accumulator for storing the accumulation value of said envelope; and an addition circuit in which an output of said accumulator and an envelope increment value are subjected to addition to calculate a new accumulation value of said envelope, means applying said new accumulation value to said selector register, said selector register, accumulator and addition circuit being connected to said plurality of registers.

10. A wave generator as claimed in claim 9, in which said instruction delivery circuit delivers a damp instruction from said microprogram memory and controls, when said damp instruction is outputted, said arithmetic circuit to shift down the value from said accumulator by a predetermined number of bits to constitute an increment value and to subtract said increment value from the content of said accumulator, the shifting down and the subtracting being conducted repeatedly, thereby realizing an exponential decay.

11. A wave generator as claimed in claim 9, in which said instruction delivery circuit delivers a damp instruction from said microprogram memory and controls, when said damp instruction is outputted, said arithmetic circuit to shift down the value from said accumulator by a predetermined number of bits to constitute an increment value and to subtract said increment value from the content of said accumulator, the shifting down and subtracting being conducted repeatedly, thereby realizing an exponential decay.

12. A wave generator as claimed in claim 2, in which said set of instructions includes an instruction to allow data for setting time intervals for said segments to be selectively set, so as to carry out calculation of said waveform.

13. A wave generator as claimed in claim 12, which comprises: a rate count register for storing predetermined rate count data with respect to said segment when the waveform calculation for each segment starts; a first control circuit for controlling said arithmetic circuit to subtract a predetermined value from the stored data value of said rate count register, and when the subtraction result reaches a set value, produces a signal; an envelope count register for storing a predetermined envelope count data of said segment when the waveform calculation for each segment starts; and a second control circuit which controls said arithmetic circuit for subtracting a predetermined value from the stored data value of said envelope count register whenever said signal is outputted by said first control circuit and produces a signal when the subtraction reaches a set value.

14. A wave generator as claimed in claim 13, in which said microprogram memory provides a hold signal and said first control circuit is connected to suspend subtraction operation of said arithmetic circuit when said hold signal is outputted.

15. A wave generator as claimed in claim 12, which comprises: a rate count register for storing predetermined rate count data with respect to said segment when the waveform calculation for each segment starts; a first control circuit for controlling said arithmetic circuit to add a predetermined value to the stored data value of said rate count register, and when the addition result reaches a set value, produces a signal; an envelope count register for storing a predetermined envelope count data of said segment when the waveform calculation for each segment starts; and a second control circuit which controls said arithmetic circuit for adding a predetermined value to the stored data value of said envelope count register whenever said signal is outputted by said first control circuit and produces a signal when the addition result reaches a set value.

16. A wave generator as claimed in claim 15, in which said microprogram memory provides a hold signal and said first control circuit is connected to suspend addition operation of said arithmetic circuit when said hold signal is outputted.

17. A wave generator as claimed in claim 12, which comprises: a rate count register for storing predetermined rate count data with respect to said segment when the wave-form calculation for each segment starts; a first control circuit for controlling said arithmetic circuit to subtract a predetermined value from the stored data value of said rate count register, and when the subtraction reaches a set value, produces a signal; an envelope count register for storing a predetermined envelope count data of said segments when the waveform calculation for each segment starts, and a second control circuit which controls said arithmetic circuit for subtracting a predetermined value from the stored data value of said envelope count register whenever said signal is outputted by said first control circuit and produces a signal when a subtraction result reaches a set value.

18. A wave generator as claimed in claim 17, in which said first control circuit is connected to add a predetermined value to the content of said rate count register and to produce a signal when the addition result reaches a set value.

19. A wave generator as claimed in claim 18, which further comprises means to generate a hold signal and said first control circuit is connected to suspend addition operation thereof when said hold signal is generated.

20. A wave generator as claimed in claim 17, in which said second control circuit is connected to add a predetermined value to the content of said envelope count register and to produce a signal when the addition result reaches a set value.

21. A wave generator as claimed in claim 17, which further comprises means to generate a hold signal, and said first control circuit is connected to suspend subtraction operation thereof when said hold signal is generated.

22. A wave generator for an electronic musical instrument, comprising:

a segment indicating signal generator for generating, one after another in sequence, a plurality of different numerical valued segment indicating signals, the segments being timewise divisions of an envelope wave to be generated;

a variation rate generator for generating a plurality of different variation rate signals, each being a signal exhibiting a numerical value, said variation rate generator being connected to said segment indicating signal generator to selectively generate a variation rate signal from among said variation rate signals according to said segment indicating signals; and a calculation circuit including an arithmetic circuit and a register and connected to said variation rate generator, for sequentially producing, by calculation using each said numerical value as a calculation increment, sample values are after another which constitute an envelope wave having wave values varying at a rate determined by the selected one of said variation rate signals for each of said segments.

23. A wave generator as claimed in claim 22, which further comprises means for generating a decay instruction signal connected to said segment indicating signal generator, and when said decay instruction signal is delivered to said segment indicating signal generator, said segment indicating signal is changed to be representative of a segment corresponding to a decay state of said envelope wave.

24. A wave generator as claimed in claim 22, which further comprises means for setting time intervals for said segments to be selectively set.

25. A wave generator as claimed in claim 22, which further comprises:

a value source generating an initial value of the envelope;

a selector register for selectively storing said initial value of said envelope and an accumulation value of said envelope which are applied thereto;

an accumulator for storing the accumulation value of said envelope; and an addition circuit in which an output of said accumulator and an envelope variation rate signal are subjected to addition to calculate a new accumulation value of said envelope, means applying said new accumulation value to said selector register, said selector register, accumulator and addition circuit being connected to said calculation circuit.

* * * * *

UNITED STATES PATENT AND TRADEMARK OFFICE

CERTIFICATE OF CORRECTION

PATENT NO. : 4,373,416

DATED : February 15, 1983

INVENTOR(S) : ENDO et al

It is certified that error appears in the above-identified patent and that said Letters Patent are hereby corrected as shown below:

COLUMN 24, LINE 35, CLAIM 22,

CHANGE "ARE" TO --ONE--

Signed and Sealed this

*Fifth* Day of *July 1983*

[SEAL]

*Attest:*

GERALD J. MOSSINGHOFF

*Attesting Officer*

*Commissioner of Patents and Trademarks*